United States Patent [19]

Geary

[11] Patent Number: 4,711,628

[45] Date of Patent: Dec. 8, 1987

[54] HOT SURFACE IGNITION SYSTEM FOR A GAS FURNACE AND METHOD OF MAKING THE SAME

[75] Inventor: Frederick J. Geary, Holland, Mich.

[73] Assignee: Robertshaw Controls Company, Richmond, Va.

[21] Appl. No.: 887,860

[22] Filed: Jul. 18, 1986

[51] Int. Cl.[4] ..... F23N 5/00

[52] U.S. Cl. ..... 431/31; 431/29; 431/70; 431/71

[58] Field of Search ..... 431/71, 69, 70, 31, 431/29

[56] References Cited

U.S. PATENT DOCUMENTS

| | | | |
|---|---|---|---|
| 2,800,176 | 7/1957 | Morrison | 431/70 |
| 4,375,951 | 3/1983 | Bohan | 431/71 |
| 4,643,668 | 2/1987 | Geary | 431/70 |

*Primary Examiner*—Carroll B. Dority, Jr.
*Attorney, Agent, or Firm*—Candor, Candor & Tassone

[57] ABSTRACT

A hot surface ignition system for a gas furnace and method of making the same are provided, the system comprising a high voltage circuit for being connected to a source of high voltage AC current, the high voltage circuit having a hot surface igniter therein and disposed in the path of gas issuing from a burner that is adapted to be fed gas from a source thereof through an electrically operated gas valve, a low voltage circuit for being connected to a source of low voltage AC current, the low voltage circuit having the gas valve therein and having a thermostatic switch therein controlling the energization of the low voltage circuit with the low voltage AC current, a first relay unit having contacts in the high voltage circuit and controlling the energization of the igniter with the high voltage AC current, and another relay unit having contacts in the low voltage circuit and controlling the energization of the gas valve, the other relay unit comprising two separate relays respectively having contacts that are disposed in series in the low voltage circuit whereby the contacts of the two relays must be in the same condition thereof to energize the gas valve.

17 Claims, 6 Drawing Figures

| OPTION TABLE | | | | | |
|---|---|---|---|---|---|
| CODE | FEATURE | IN | OUT | R9 | R21 |
| P | PRE-PURGE | W5 | Q3,R13,R8 | | |
| N | NON PRE-PURGE | Q3,R13,R8 | W5 | | |
| L | LOCAL SENSE | W1 | | | |
| R | REMOTE SENSE | | W1 | | |
| | IGNITION ATTEMPTS: PRE-PURGE | | | | |
| 1 | 1 ATTEMPT | D4 | D3,D5 | | |
| 2 | 2 ATTEMPTS | D3 | D4,D5 | | |
| 3 | 3 ATTEMPTS | D3,D4 | D5 | | |
| | IGNITION ATTEMPTS: NON PRE-PURGE | | | | |
| 1 | 1 ATTEMPT | D5 | D3,D4 | | |
| 2 | 2 ATTEMPTS | D4,D5 | D3 | | |
| 3 | 3 ATTEMPTS | D3,D5 | D4 | | |
| 4 | 4 ATTEMPTS | D3,D4,D5 | | | |
| 04 | VALVE TIME 4 SECONDS | | | 40.2K 1% | 120K 1% |
| 08 | VALVE TIME 8 SECONDS | | | 82.5K 1% | 430K 2% |
| 12 | VALVE TIME 12 SECONDS | | | 130K 1% | 680K 2% |

HOT SURFACE IGNITION SYSTEM FOR A GAS FURNACE AND METHOD OF MAKING THE SAME

BACKGROUND OF THE INVENTION

1. Field of the Invention

This invention relates to a new hot surface ignition system for a gas furnace and the like as well as to a new method of making such a hot surface ignition system.

2. Prior Art Statement

It is known to provide a hot surface ignition system for a gas furnace and comprising a high voltage circuit for being connected to a source of high voltage AC current, the high voltage circuit having a hot surface igniter means therein and disposed in the path of gas issuing from the burner means that is adapted to be fed the gas from a source thereof through an electrically operated gas valve, a low voltage circuit for being connected to a source of low voltage AC current, the low voltage circuit having the gas valve therin and having thermostatic switch means therein controlling the energization of the low voltage circuit with the low voltage AC current, first relay means having contact means in the high voltage circuit and controlling the energization of the igniter means with the high voltage AC current, and other relay means having contact means in the low voltage circuit and controlling the energization of the gas valve. For example, see applicant's copending patent application Ser. No. 624,014, filed June 25, 1984, now U.S. Pat. No. 4,643,668, wherein the other relay means has a single coil means in the low voltage circuit and two pairs of contacts operated by the coil means and being disposed in the low voltage circuit in parallel with one pair of the contacts being normally closed and the other pair of the contacts being normally open.

SUMMARY OF THE INVENTION

It is one feature of this invention to provide a new hot surface ignition system for a gas furnance or the like wherein a unique arrangement of relay means is provided in the low voltage circuit for controlling the operation of the electrically operated gas valve of the system.

In particular, it was found according to the teachings of this invention that two separate relays can be provided in the low voltage circuit and can respectively have the contact means thereof disposed in series in the low voltage circuit so that both relays must have the contact means thereof operated to the same condition thereof before the gas valve can be energized.

For example, one embodiment of this invention provides a hot surface ignition system for a gas furnace and comprising a high voltage circuit for being connected to a source of high voltage AC current, the high voltage circuit having a hot surface igniter means therein and disposed in the path of gas issuing from a burner means that is adapted to be fed the gas from a source thereof through an electrically operated gas valve, a low voltage circuit for being connected to a source of low voltage AC current, the low voltage circuit having the gas valve therein and having thermostatic switch means therein controlling the energization of the low voltage circuit with the low voltage AC current, first relay means having contact means in the high voltage circuit and controlling the energization of the igniter means with the high voltage AC current, and other relay means having contact means in the low voltage circuit and controlling the energization of the gas valve, the other relay means comprising two separate relays respectively having contact means that are disposed in series in the low voltage circuit whereby the contact means of the two relays must be in the same condition thereof to energize the gas valve.

Accordingly, it is an object of this invention to provide a new hot surface ignition system for a gas furnace or the like, the system of this invention having one or more of the novel features of this invention as set forth above or hereinafter shown or described.

Another object of this invention is to provide a new method of making a hot surface ignition system for a gas furnace or the like, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIGS. 2A, 2B and 2C respectively illustrate various parts of the hot surface ignition system of this invention and when placed together in the manner illustrated in FIG. 1 will illustrate the entire hot surface ignition system of this invention.

DESCRIPTION OF THE PREFERRED EMBODIMENTS

Figures 1, 2A:
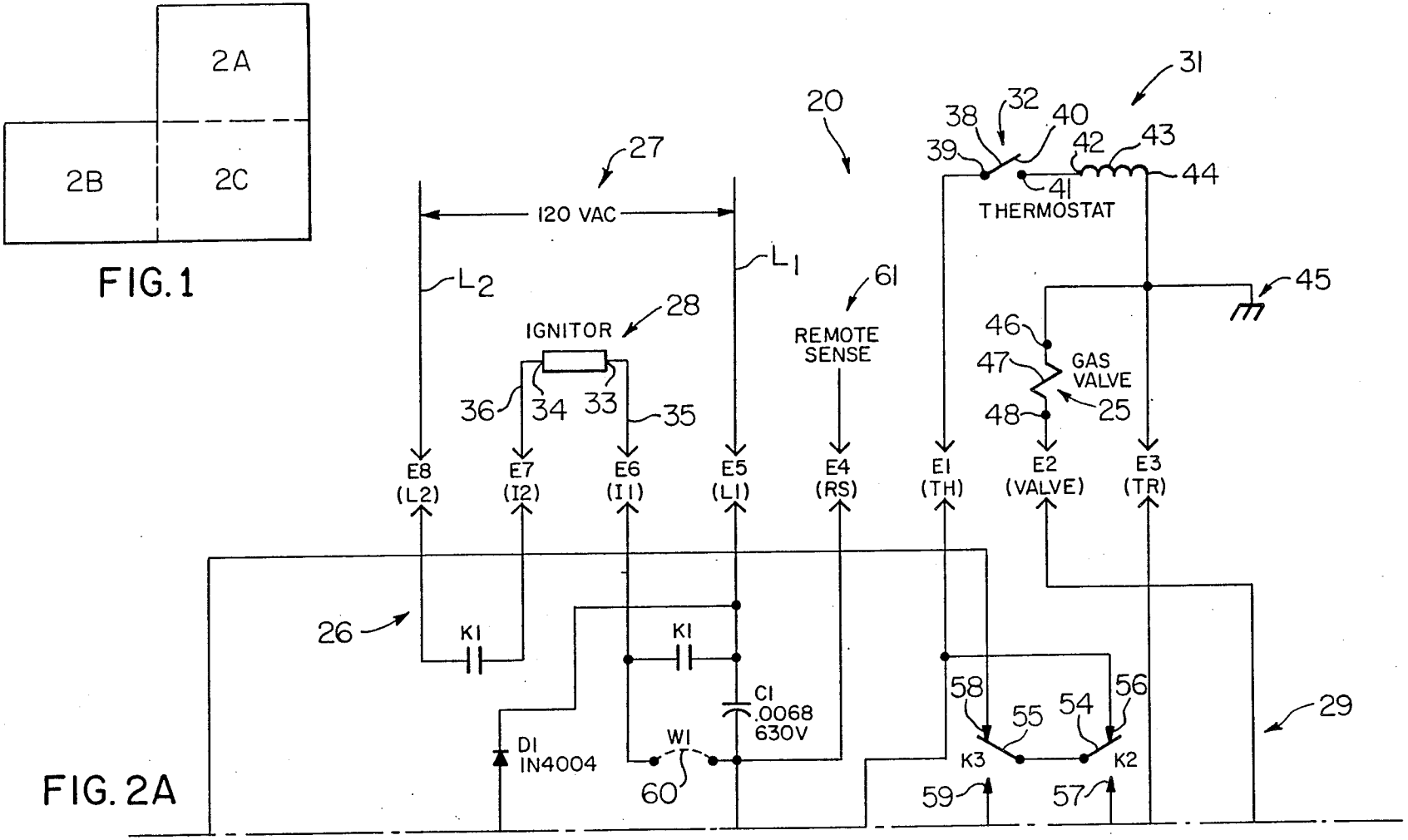
FIG. 1 is a schematic view illustrating how
FIGS. 2A, 2B and 2C are to be positioned relative to each other in order to illustrate the entire wiring circuit for the hot surface ignition system of this invention.

While the various features of this invention are hereinafter illustrated and described as being particularly adapted to provide a hot surface ignition system for a gas furnace, it is to be understood that the various features of this invention can be utilized singly or in various combinations thereof to provide a hot surface ignition system for other apparatus as desired.

Therefore, this invention is not to be limited to only the embodiments illustrated in the drawings, because the drawings are merely utilized to illustrate one of the wide variety of uses of this invention.

Figures 3, 4:
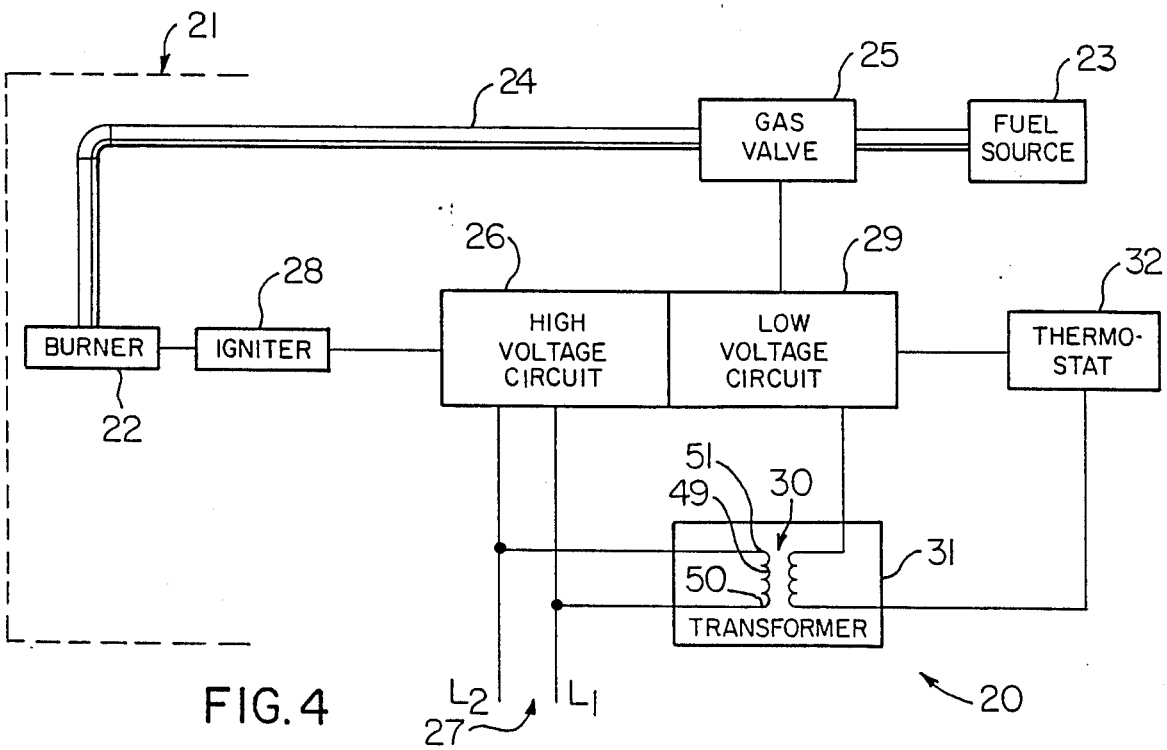
FIG. 3 is a table illustrating how the hot surface ignition system of this invention can be modified to provide various embodiments thereof.
FIG. 4 is a schematic view mainly in block diagram form, illustrating the hot surface ignition system of this invention.

Referring now to FIG. 4, the new hot surface ignition system of this invention is generally indicated by the reference numeral 20 and is utilized for a gas furnace that is generally indicated by the reference numeral 21 and has a main burner 22 therein that is adapted to be supplied fuel thereto from a fuel source 23 through a conduit means 24 when an electrically operated gas valve 25 is open in a manner hereinafter set forth, the gas valve 25 being part of the hot surface ignition system 20 that further comprises a high voltage circuit 26 being interconnected to a source of high voltage AC current L1, L2, such as an 120 volt alternating current source. The high voltage circuit 26 has a hot surface igniter means 28 therein that is disposed in the path of gas issuing from the burner means 22. The hot surface ignition system 20 also comprises a low voltage circuit 29 for being connected to a source 30 of low voltage AC current, such as provided by a stepdown transformer 31 in a manner well known in the art, the low voltage circuit 29 having the gas valve 25 therein and having a thermostatic switch means 32 therein for controlling the energization of the low voltage circuit 29 with the low voltage AC current 30.

As illustrated in FIG. 2A, the high voltage circuit 26 is interconnected to the high voltage source 27 by contact pins E5 and E8 being respectively interconnected to the power source lines L1 and L2 with line L1 being the hot line and line L2 being the neutral line as is well known in the art. The igniter 28 in FIG. 2A has its opposed ends 33 and 34 interconnected by leads 35 and 36 respectively to contact pins E6 and E7.

The contact pins E7 and E8 of the system 20 are adapted to be interconnected to each other when one pair of normally open relay contact means K1 are closed. Likewise, contact pins E5 and E6 are adapted to be electrically interconnected together when the other pair of normally open relay contacts K1 are closed. The two pairs of relay contacts K1 are in the high voltage circuit 26 and are controlled by a relay coil K1 of FIG. 2B that is disposed in the low voltage circuit 29 so that when the coil K1 is energized, the relay contacts K1 are closed and the igniter 28 is placed across the power source 27 and when the relay coil K1 is deenergized, the contacts K1 return to the normally open condition thereof and disconnect the igniter 28 from the high voltage AC current 27.

Figure 2B:
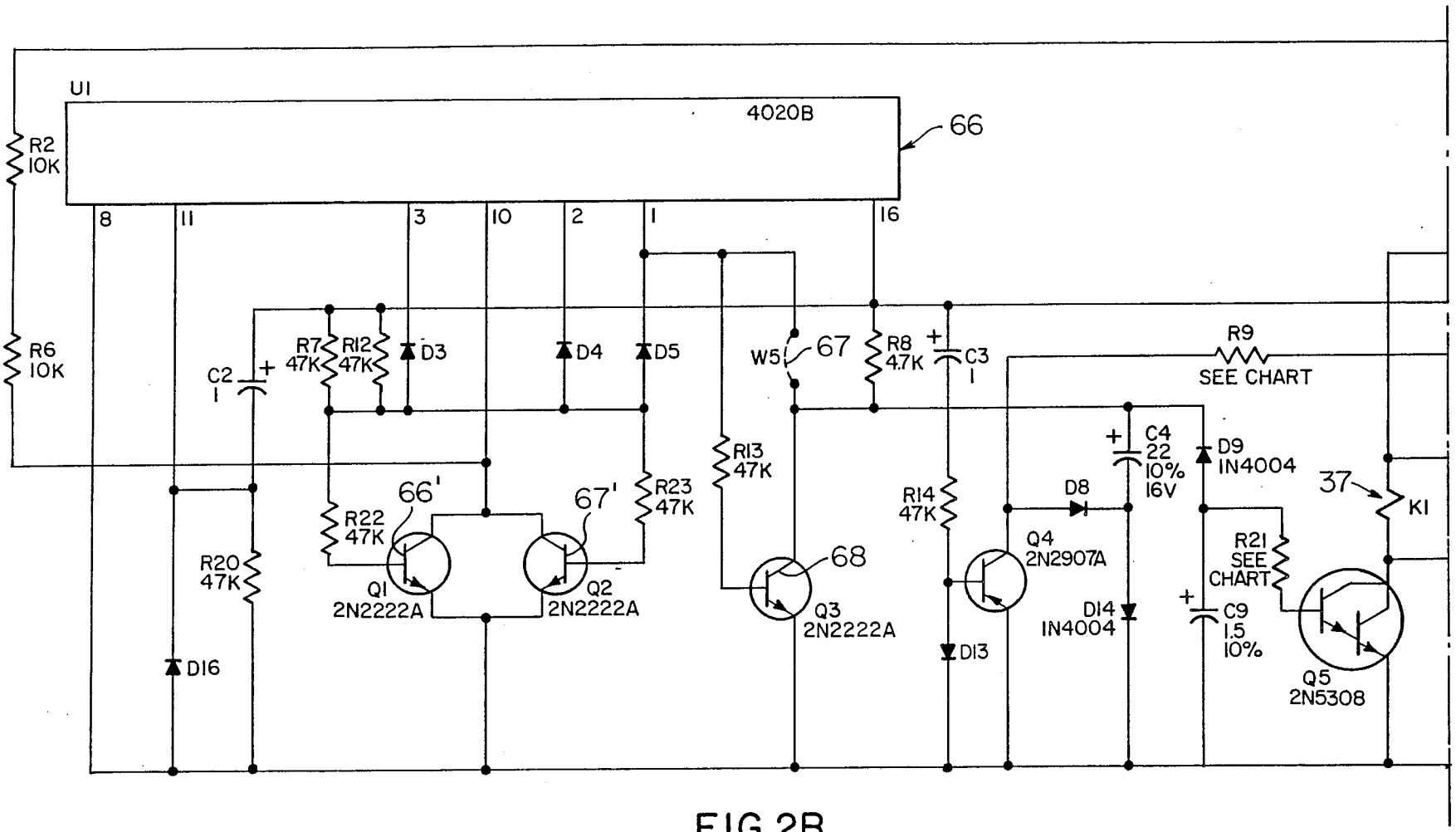

Thus, it can be seen that the relay contacts K1 and relay coil K1 comprise a relay means of the system 20 that is generally indicated by the reference numeral 37 in FIG. 2B.

The thermostat 32 of the ignition system 20 of this invention is shown as a switch blade 38 in FIG. 2A that has one end 39 thereof electrically interconnected to contact pin E1 and the other end 40 thereof adapted to be placed against a fixed contact 41 when the thermostat 32 senses that heat should be provided by the burner means 22 in a manner well known in the art, the contact 41 being electrically interconnected to one side 42 of a secondary coil 43 of the transformer 31 while the other side 44 of the secondary coil 43 is electrically interconnected to ground 45, to contact pin E3 and to one side 46 of an operating coil 47 of the gas valve 25 which has its other side 48 interconnected to the contact pin E2.

Figure 2C:
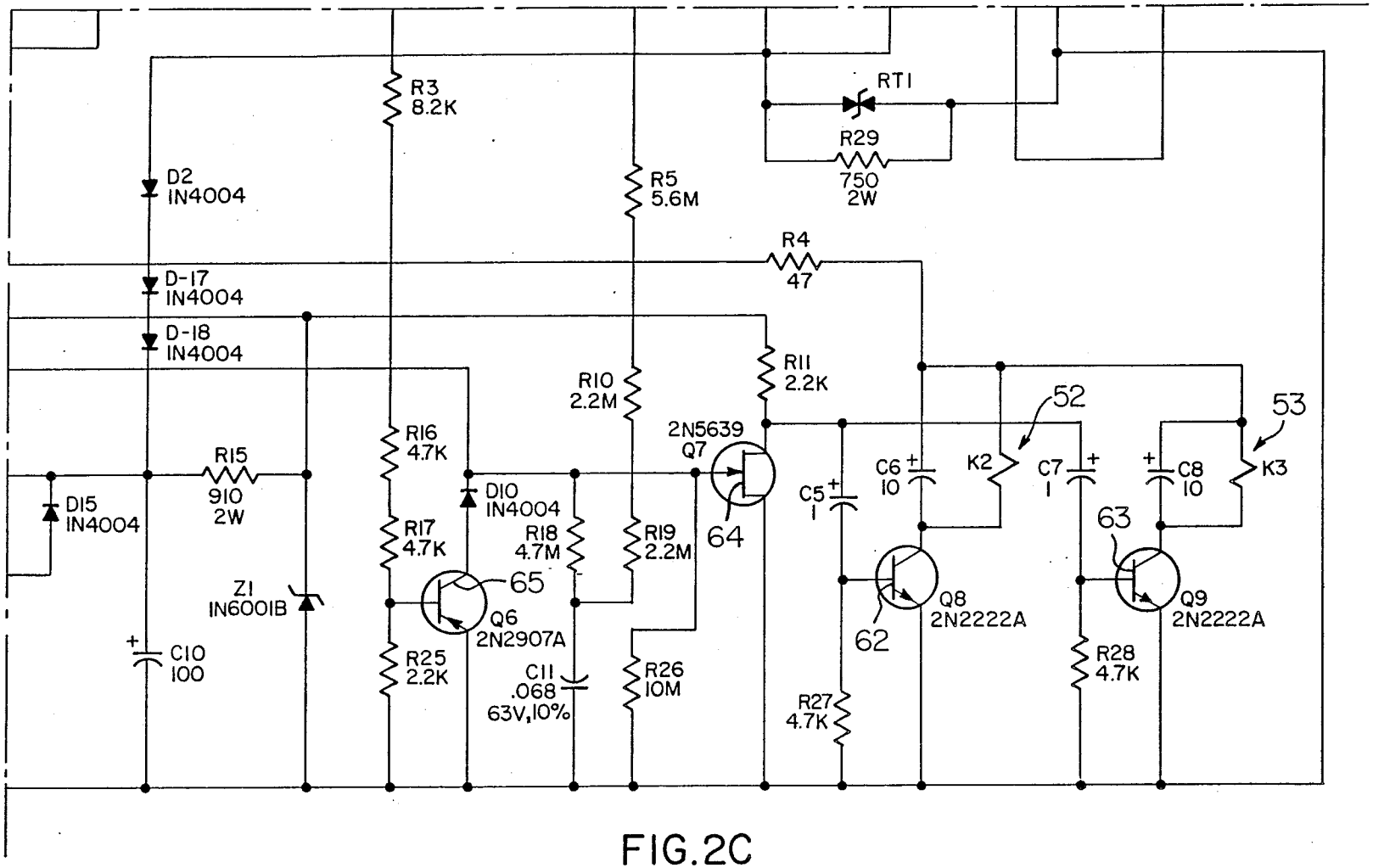

As illustrated in FIG. 4, the transformer 31 has a primary coil 49 that has its opposed ends 50 and 51 respectively electrically interconnected to the power source leads L1 and L2 whereby the transformer 31 provides the source of low voltage AC current 30, such as 24 volts AC in a manner well known in the art, for the low voltage circuit 29 of the system 20 that comprises substantially the entire remainder of the electrical circuit illustrated in FIGS. 2A, 2B and 2C and which will be hereinafter described.

The low voltage circuit 29 includes two other relay means that are respectively and generally indicated by the reference numerals 52 and 53 in FIG. 2C, the relay means 52 and 53 respectively having coil means K2 and K3 disposed in parallel in the low voltage circuit 29 and respectively having contact means K2 and K3, illustrated in FIG. 2A, that comprise movable contact means 54 and 55 and spaced apart stationary contact means 56, 57 and 58, 59. The movable contacts 54 and 55 of the contact means K2 and K3 are respectively normally disposed against the fixed contacts 56 and 58 when the coil means K2 and K3 are in a deenergized condition thereof and are moved and held against the fixed contacts 57 and 59 when the relay coil means K2 and K3 are energized in a manner hereinafter set forth.

In general, the operation of the hot surface ignition system 20 of this invention is that as long as the thermostat 32 is satisfied so that the movable contact 38 is in the open condition as illustrated in FIG. 2A, the first relay means 37 is in a deenergized condition so that the contacts K1 thereof are disposed in the open condition as illustrated in FIG. 2A whereby the igniter 28 is disconnected from the high voltage AC current 27. Under such conditions, the coil means K2 and K3 of the other relay means 52 and 53 are also in a deenergized condition so that the contact means K2 and K3 thereof are in the normal condition illustrated in FIG. 2A wherein the movable contacts 54 and 55 thereof are in contact with the fixed contacts 56 and 58.

However, upon the thermostat 32 demanding heat from the burner means 22, the switchblade or movable contact 38 of the thermostat is now disposed against the fixed contact 41 so that the transformer 31 now supplies the source 30 of low voltage AC current to the contact pins E2 and E3 and will, thus, cause the system 20 to either begin to immediately have the igniter 28 interconnected to the power source 27 by operating the first relay means 37 in a nonpurge operation of the system 20 or to have the igniter means 28 interconnected to the high voltage current 27 after a prepurge time period has lapsed, such as after approximately 34 seconds. In any event, the system 20 is adapted to operate the igniter 28 for a certain period of time to heat up the same, such as for a period of 34 seconds, after which the gas valve 25 is operated by the energizing of the relay coils K2 and K3 in a manner hereinafter set forth to permit fuel to flow from the fuel source 23 to the burner 22 so that the same can issue from the burner 22 and be ignited by the hot surface of the igniter 28 in a manner well known in the art. Should the igniter 28 ignite the gas issuing from the burner 22, the igniter 28 then can act as a flame sensing means for the system 20 in a manner hereinafter set forth so that when the igniter 28 is to be utilized as the flame sensing means for the system 20, the low voltage circuit 29 has a jumper 60 of FIG. 2A disposed therein. However, if the burner means 22 comprises a plurality of burners disposed in side-by-side relation so that the igniter 28 is being utilized to merely ignite one of the burners which in turn then will ignite the next burner and so on until the last burner is ignited, a remote flame sensing means can be utilized and the same is generally indicated by the reference numeral 61 in FIG. 2A and is adapted to be interconnected to contact pin E4. When the remote flame sense means 61 is utilized, the jumper 60 of the circuit 29 is removed so that the igniter 28 will not act as the flame sensing means under those conditions.

Once flame sensing has been detected by either the igniter 28 or the remote sense means 61, such flame sensing means maintains the energization of the relay coils K2 and K3 so that the movable contacts 54 and 55 thereof are maintained against the fixed contacts 57 and 59, so that the gas valve 25 will be in an open condition to continuously supply fuel to the burner means 22.

However, once the thermostat 32 is again satisfied, the movable contact 38 thereof is moved away from the fixed contact 41 to disconnect the low voltage alternating current from the low voltage circuit 29 so that the relay coils K2 and K3 are deenergized and cause the contacts 54 and 55 thereof to move away from the fixed contacts 57 and 59 and against fixed contacts 56 and 58 whereby the electrically operated gas valve 25 now closes and terminates the flow of fuel from the source 23 to the burner means 22 and the system 20 is now in a condition to again ignite the burner means 22 and operate the same in the manner previously described once the thermostat 32 again demands heat in the manner previously set forth.

The details of the system 20 for operating in the above manner and in the manner hereinafter set forth will now be described.

As previously stated, when the igniter 28 heats up to ignition temperature, such as a temperature of about 3000° F., the gas that issues from the burner means 22 and sprays over the hot surface of the igniter 28 and if ignition occurs, the electronic circuitry of the system 20 will sense that combustion has occurred and will maintain the gas valve 25 in its open condition. However, if ignition does not occur, the low voltage circuit 29 will close the gas valve 25 and then go through another trial ignition period and depending upon how the system 20 is set up, up to three and sometimes four trials for ignition can be provided by the system 20 before the system 20 will go into a lockout condition that will no longer allow trials for ignition and the only way that the control system 20 can be taken out of lockout is for the thermostat 32 to be turned off and then back on, such off/on period for the thermostat 32 being about a second that will reset the control system 20 and allow it to try again for ignition.

As illustrated in FIG. 2C, the low voltage circuit 29 is provided with transistors Q8 and Q9 that are respectively relay driver transistors for the relay coil means K2 and K3. An AC signal into the base 62 of the transistor Q8 and into the base 63 of the transistor Q9 will energize the respective relay coil means K2 and K3 of the relays 52 and 53 and thereby pull in the relays 52 and 53 to move the movable contacts 55 and 56 thereof downwardly in FIG. 2A to be against the lower fixed contacts 57 and 59. If the signal to the bases 62 and 63 of the transistors Q8 and Q9 become DC, capacitor C5 and C7 of the low voltage circuit 29 will not pass the DC signals. The portion of the low voltage circuit 29 that drives the transistors Q8 and Q9 comprises the combination of a field effect transistor Q7 and a PNP transistor Q6.

The properties of the field effect transistor Q7 is that with no voltage on its gate 64 and since the field effect transistor Q7 is an NPN depletion mode field effect transistor, the field effect transistor Q7 is almost like a short circuit in that it has an effective resistance of about 60 ohms. Thus, if a DC signal is applied to the drain through a resistor, most of the voltage will be dropped across a series resistor and very little voltage will be across the field effect transistor Q7. If, however, a negative voltage is put into the gate 64 of the field effect transistor Q7, the field effect transistor Q7 will become a very high resistance device and most of the voltage would be developed across the field effect transistor Q7 from drain to ground. In this manner, if the voltage to the gate 64 of the field effect transistor Q7 periodically goes from 0 to some negative voltage then back to 0 and then to some negative voltage at a cycling rate, the output from the field effect transistor Q7 would follow this and go up down, up down, etc. which produces an AC drive signal that is allowed to go through capacitors C5 and C7 of the circuit 29 to activate the transistors Q8 and Q9 of the circuit and turn the relay means 52 and 53 to their on condition by energizing the relay coil means K2 and K3.

The PNP transistor Q6, which is interconnected to the gate 64 of the field effect transistor Q7, has a 60 cycle signal applied to its base by the circuit 29 in a manner hereinafter set forth whereby the PNP transistor Q6 is turning on and off at a 60 cycle rate. If there is a negative voltage applied to the gate 64 of the field effect transistor Q7, this negative voltage is also applied to the collector 65 of the transistor Q6 by the low voltage circuit 29 in a manner hereinafter set forth. Since the transistor Q6 is turning on and off at a 60 cycle rate, it follows that the voltage at the gate 64 of the field effect transistor Q7 is also going from 0 to some negative value at a 60 cycle rate. As long as there is a negative input voltage coming into the gate 64 of the transistor Q7 and the transistor Q6 is turning on and off at a 60 cycle rate, the relay driver transistors Q8 and Q9 are getting a signal that will pull the relays 52 and 53 in.

Thus, it can be seen that a negative voltage must be imposed on the gate 64 of the field effect transistor Q7 in order to have the relays 52 and 53 pull in. The system 20 provides two sources for this negative voltage, one of which is from a flame rectification sense signal. For example, when the igniter 28 is acting as a flame sense means and the jumper 60 is in the circuit 29, it will sense a flame at the burner means 22 because of the charging going on between capacitors C1, FIG. 2A, and C11, FIG. 2C. Since the capacitor C1 will charge more net negative than it will charge net positive, which is how flame rectification operates in a manner well known in the art, this negative voltage will be transferred through resistors R5, R10 and R19 to the capacitor C11 and therefore a negative to positive voltage will develop across the capacitor C11. This negative voltage is then applied to the gate 64 of the field effect transistor Q7 through resistor R18 so that as long as there is a flame sense, there is a negative voltage applied to the gate 64 of the field effect transistor Q7 and the relays 52 and 53 will come in and stay in.

However, in order to have the relays 52 and 53 close in the first place before ignition occurs at the burner means 22, the relays 52 and 53 must first close in order to open the gas valve 25 and therefore the system 29 will apply a negative voltage to the gate 64 of the field effect transistor Q7 by another source thereof than the flame rectification that was previously described.

Thus, with the relays K2 and K3 deenergized and the thermostat 32 initially closing the movable contact 38 against the fixed contact 41 so as to start the operation of the system 20 to supply heat by the burner means 22, a low voltage AC current signal is passed from the closed thermostat 32 through the closed contacts 56, 54 and closed contacts 55, 58 of the deenergized relay means 52 and 53 through two resistors R2 and R6 into a pin 10 of a conventional 4020B divide by 14 electronic counter that is generally indicated by the reference numeral 66 in FIG. 2B. Thus, pin 10 is a clock input to the counter 66 and pins 1, 2 and 3 of the counter 66 are the outputs thereof. The input signal to the counter 66 causes the counters of the clock circuit therein to begin to divide the frequency of the input signal in a manner well known in the art so that the counter 66 will give an output signal on pin 1 after approximately 34 seconds and then after another approximately 34 seconds it will cause the output on the pin 1 to go back to 0 and will continue to do this every 34 seconds. Thus, the voltage on the pin 1 will switch from 0 to approximately 11 volts for 34 seconds and then go back to 0 for 34 seconds and then back to 11 volts in a 34 second cycling rate in a manner well known in the art.

In a prepurge operation of the system 20 of this invention, the resistors R13, R8 and transistor Q3 are removed from the circuit 29 and the jumper 67 is included in the system 29. However, the jumper 67 is removed and the resistors R13 and R8 and transistor Q3 are included in the circuit 29 when the circuit 29 is to operate in a non-prepurge manner as will be apparent hereinafter.

Thus, after the input signal is applied to the pin 10 of the counter 66 and after approximately 34 seconds, the voltage at the output pin 1 goes to a positive voltage of approximately 11 volts and it charges a capacitor C4 through a diode D14 and it charges another capacitor C9 through a diode D9. When a potential is created across the capacitor C9, the capacitor C9 turns on a transistor Q5 which, in turn, energizes the relay coil K1 of the relay means 37 and thereby closes the relay contacts K1 to place the igniter 28 across the high voltage AC current 27. In this manner, the igniter 28 begins its heat up cycle. The voltage on the output pin 1 of the counter 66 will remain there for approximately 34 seconds so therefore the transistor Q5 is on for approximately 34 seconds whereby the igniter 28 has power applied to it for approximately 34 seconds. At the end of this 34 seconds, the voltage on the counter output pin 1 drops back down to ground potential and the charge on capacitor C9 begins to bleed off through a resistor R21. This bleed off period is designed to be approximately one-half of the desired on time for the gas valve 25 for a trial ignition period. In otherwords, if it is desired to leave the gas valve 25 on for approximately 4 seconds to try for ignition, it is desired to leave the igniter 28 on for the first approximately 2 seconds of that 4 second period so that a full powered up condition will be provided for ignition. Thus, it is desired to have an on time of approximately 12 seconds for the gas valve 25, then it is desired to leave the igniter 28 on for an additional 6 seconds beyond the time that the output pin 1 goes back to ground potential. In this manner, during halfway through the time period for the trial for ignition, the igniter 28 is at full power and there will be no cooling down of the igniter 28 during the first half of the on time of the gas valve 25 and this is a result of the timing means provided by the combination of the capacitor C9 and resistance R21. It can be seen from FIG. 3 that by selecting various values for the resistance R21 various valve on times can be provided for the gas valve 25.

Also, the capacitor C4 has been charged up during the on time of the output pin 1 so that when the voltage on the pin 1 drops to ground potential, there is no longer any potential trying to keep capacitor C4 charged up. The capacitor C4 cannot discharge through the diode D14 to ground because of the polarity of the diode D14, but it can discharge through a diode D8 and through a resistance R9 into the gate 64 of the field effect transistor Q7 and this signal from the discharge of the capacitor C4 through the diode D8 and the resistance R9 is a negative voltage. Since a negative voltage is now at the gate 64 of the field effect transistor Q7, it causes the field effect transistor Q7 to want to go to a high resistance state but the PNP transistor Q6 dumps this to ground at a 60 cycle rate so therefore the output from the field effect transistor drain to ground is fed into the bases 62 and 63 of the transistors Q8 and Q9 as an AC signal. This AC signal is coupled through the capacitors C5 and C7 and allows the transistors Q8 and Q9 to pull in their respective relays 52 and 53. The pull in of the relays 52 and 53 causes the movable contacts 54 and 55 to move against the fixed contacts 57 and 59 and thereby interconnect the contact pin E1 with the contact pin E2 so that the coil 47 of the gas valve 25 is energized to open the gas valve 25. In this manner, gas is now pushed through the burner means 22 across the hot surface of the igniter 28 and if combustion occurs when the igniter drops out because the contacts K1 now open when the capacitor C9 is completely discharged so as to terminate the operation of the transistor Q5 and permit the relay 37 to have the coil K1 thereof deenergized, the igniter 28 will now be able to then act as a sensor and flame rectification will occur. This flame recitification will reinforce the negative voltage that is being put into the gate 64 of the field effect transistor Q7 and keep the field effect transistor Q7 turned on. Therefore, if the field effect transistor Q7 is continued to be supplied with the negative voltage through the flame rectification, the transistors Q8 and Q9 will still hold the relays 52 and 53 in their pulled in condition and there will still be a continuation flow of gas through the energized gas valve 25 and combustion will have been proved.

Since the igniter 28 is being energized for the first half cycle of the trial period for ignition, flame sense cannot be provided by the igniter 28 for the first half of this trial period and this is strictly to ensure that a hot surface will be provided by the igniter 28 for the gas to ignite on. For the remaining half cycle of this gas on period, flame sensing is provided by the igniter 28 and a minimum of about 1 second is provided for this flame sensing which is a sufficient time period for the system 20 to operate properly. Therefore, if flame rectification is not provided during this time period, the charge from the capacitor C4 finally bleeds off to a point where the field effect transistor Q7 can no longer couple this AC signal to the transistors Q8 and Q9 and therefore the relays 52 and 53 drop out so that the movable contacts 54 and 55 thereof move away from the fixed contacts 57 and 59 to terminate the operation of the gas valve 25. Also, the movable contacts 54 and 55 of the deenergized relays 52 and 53 move against the fixed contacts 56 and 58 under this condition so that they return to their normally closed condition for reapplying the clock signal to the counter 66. At the time when the relays 52 and 53 were pulled in for the previously described trial ignition attempt, there was no clock signal being applied to the input pin 10 of the counter 66 so that the system 20 went from digital timing when the clock signal was applied to the counter 66 to analog timing when the relays 52 and 53 were pulled in. Therefore, if ignition is not accomplished, the relays 52 and 53 go back to the normally closed position and will reapply the clock signal to the pin 10 of the counter 66 as previously set forth. If only the output pin 1 of the counter 66 has been connected to transistors Q1 and Q2 when the pin 1 came on with a positive voltage, it would have turned these two transistors Q1 and Q2 on and dumped the clock signal to ground so that there would have been only one trial period for ignition. However, in the circuit illustrated in the drawings, there is an output from the pin 2, an output from the pin 1 and an output from the pin 3 respectively through diodes D4, D5 and D3 which are all coupled into the bases 66 and 67 of the transistors Q1 and Q2. The transistors Q1 and Q2 are a redundant pair so that if one transistor should open or short, the other one is still in effect and will control the clock signal. Whenever there is a voltage into the base 66 or 67 of either one of the transistors Q1 and Q2, they dump the clock signal and the counter 66 can no longer count and it stays in the state that it was in at that time and this is known as a lockout. From that time on there is no longer a progress in the circuit because there is no clock signal available to do anything. Therefore, it can be seen that how many trials for ignition are provided for the system 20 will depend on which diode was inserted into the low voltage circuit 29 thereof and this is made clear by the option table of FIG. 3.

When it is desired for a non-prepurge operation to be provided by the system 20 of this invention, the resistors R13 and R8 and the transistor Q3 are included in the system 20 as illustrated and the jumper 67 thereof is removed. Thus, when the thermostat 32 closes, there is no voltage as usual coming out of the output pin 1 of the counter 66. However, with the transistor Q3 in the circuit 29 the voltage at the collector 68 of the transistor Q3 is already high and therefore the capacitor C9 will immediately charge up and turn on the igniter 28. Thus, it can be seen that the igniter 28 turns on immediately without a 34 second wait as in the prepurge operation previously described. If ignition does not occur at the end of this period, there is a waiting period of approximately 34 seconds before the system 20 again tries for ignition. Therefore all that the non-prepurge system has done is to shift the 34 second period.

Thus, it can be seen that with a prepurge operation of the system 20, there is a wait for approximately 34 seconds before the igniter 28 comes on and that if ignition is not provided, the system 20 goes into a prepurge mode again for an additional 34 seconds and then ignition is attempted again. With a non-prepurge version of the system 20, the igniter 28 is immediately turned on and if ignition is not obtained, there is a wait for approximately 34 seconds and then the system again tries for ignition.

The transistor Q4 is connected to the discharge capacitor circuit of the capacitor C4 and is utilized as a reset network. Thus, when power is first turned on for the circuit 29, the capacitor C3 will be charged up through the resistor R14 and the diode D13 and since the transistor Q4 is a PNP transistor, the transistor Q4 will not be turned on during the charging of the capacitor C3. However, if power is removed from the circuit 29, the capacitor C3 will discharge through the resistor R14 and the base emittor junction of the transistor Q4 back to the residual resistance of the circuit and momentarily turns on the transistor Q4 which then dumps the charge on the capacitor C4 so that the system 20 can be operated again. For instance, if in the middle of a gas valve on cycle, should somebody actuate the thermostat 32 so as to turn it on and off, this action would discharge the capacitor C4 so that the system 20 would start its operation all over again and this is part of a reset network of the system 20. This reset network for the counter 66 comprises the capacitor C2 and the resistance R20 so that when the system 20 is first turned on it resets the counter 22 and thereby brings it back to its zero starting point.

The rest of the circuit means 29 of this invention as illustrated in FIGS. 2A–2C need not be further described in detail because the various parts thereof and operation thereof are obvious to a person skilled in the art and it can be seen that unless otherwise specified in such FIGS. 2A–2C, all diodes therein are IN4148, all capacitance values are in microfarads, 50 V, 20% and all resistant values are in ohms, 0.25 W, 5%.

From the above description of the hot surface ignition system 20 of this invention, it can be seen that the contact means K2 and K3 of the relay means 52 and 53 are both in the normally closed condition illustrated in FIG. 2A wherein the movable contacts 54 and 55 thereof are disposed against the fixed contacts 56 and 58 when the thermostat 32 is in an open condition so that when the thermostat 32 moves to a closed condition, the relay contacts K2 and K3 can send a signal to the counter 66. However, if the relay contacts K2 or K3 are in some other position, i.e., the relay contacts K2 or K3 are already energized when the voltage input is provided by the thermostat 32, the system 20 will never have the counter 66 counting the 60 cycles so that an ignition attempt will not happen because a dead circuit is provided and the gas valve 25 cannot be open because one of the relays 52 and 53 must be in a pulled in condition and that prevents the signal from the closing thermostat 32 to pass to the counter 66. Therefore, it can be seen that the counter 66 cannot begin its count because both relays 52 and 53 must be in a deenergized condition thereof at the time the thermostat 32 closes.

If for some reason the capacitor C5 or the capacitor C7 is shorted, which would put a DC voltage on that transistor Q8 or the transistor Q9 and pull in either the relay 52 or the relay 53, there is a failure of the system 20 but that failure will not permit the counter 66 to begin its counting and therefore will not allow the other relay K2 or K3 to be pulled in and thereby operate the gas valve 25 because the system 20 requires both relays 52 and 53 to be pulled in in order to operate the gas valve 25.

From the above, it can be seen that by the two separate relays 52 and 53 having their contact means K2 and K3 in series in the low voltage circuit 29 a unique arrangement is provided for the system 20 of this invention.

From the above, it can be seen that the system 20 operates in a unique manner.

In particular, when the thermostat 32 initially closes, a low voltage AC current is passed through the relay contacts K2 and K3 as the same are in the condition illustrated in FIG. 2A so that a signal is provided at the input pin 10 of the counter 66 and the counter 66 begins to count. In the prepurge operation of the system 20, approximately 34 seconds passes before a positive voltage appears on the output pin 1 of the counter 66 and this causes a charging up of the capacitors C4 and C9. When capacitor C9 has a potential across it, capacitor C9 turns on the transistor Q5 which, in turn, energizes the relay coil K1 of the relay means 37 to cause its relay contacts K1 to close and thereby place the igniter 28 across the high voltage AC current 27 to heat up the igniter 28 to an ignition temperature thereof. After approximately 34 seconds, the counter 66 causes the voltage on the output pin 1 to drop to ground potential whereby the charged capacitor C9 now begins to discharge and thereby maintain the relay coil K1 of the relay means 37 energized for the first half of the time that the gas valve 25 will be operating for the first ignition attempt. At this time, the charged capacitor C4 also discharges through the diode D9 and the resistance R9 into the gate 64 of the field effect transistor Q7 which through the cooperation of the transistor Q6 in the manner previously described causes the field effect transistor Q7 to develop an AC signal that is coupled through the capacitor C5 and C7 and allows the transistors Q8 and Q9 to pull in their respective relays 52 and 53 by energizing the relay coils K2 and K3 thereof whereby the relay contacts K2 and K3 are operated so that the movable contacts 54 and 55 move away from the fixed contacts 56 and 58 and are placed in contact with the fixed contacts 57 and 59. In this condition of the pulled in relays 52 and 53, the signal from the closed thermostat 32 now passes from the contact pin E1 to the contact pin E2 through the closed contacts 55, 59 and 56, 57 to energize the coil 46 of the gas valve 25 and thereby cause the gas valve 25 to direct fuel across the heated igniter 28.

If the igniter 28 ignites the fuel and is being used as the flame sense for the system 20, the capacitor C9 is finally dissipated and thereby causes the transistor Q5 to deenergize the coil K1 of the relay 37 so that the relay contacts K1 open and thereby disconnect the igniter 28 from the high voltage AC current 27. However, because the igniter 28, through flame rectification, is interconnected into the low voltage circuit 29 by the jumper 60, the voltage developed between the capacitors C1 and C11 is negative and is imposed upon the gate 64 of the transistor Q7 as previously described so that even though the capacitor C4 has the charge thereon now dissipated, the field effect transistor Q7 continues to supply an alternating current signal to the gates 62 and 63 of the transistors Q8 and Q9 to maintain the relay coils K2 and K3 of the relay means 52 and 53 energized so that the contacts 54 and 55 remain against the fixed contact 57 and 59 and the gas valve 25 continues to supply gas to the burner 22 until the thermostat 32 opens. The opening of the thermostat 32 removes the low voltage current from the low voltage circuit 29 and thereby the coils K2 and K3 of the relays 52 and 53 are deenergized and cause the relay contacts K2 and K3 thereof to have the movable contacts 54 and 55 moved away from the fixed contacts 57 and 59 to deenergize the gas valve 25 and be placed against the fixed contacts 56 and 58 so that the system 20 is now ready to again operate the counter 66 for ignition purposes when the thermostat 32 subsequently closes, the deenergizing of the gas valve 25 thereby terminating the flow of fuel to the burner 22.

As previously stated, should ignition not occur during the time the capacitor C4 is discharging, then the counter 66, depending upon how many ignition attempts are provided by the system 20 as indicated by the chart in FIG. 3, will cause additional attempts until the transistors Q1 and Q2 provide a lockout which can only be corrected by momentarily closing and opening the thermostat 32 in the manner previously described.

The above described operation of the hot surface ignition system 20 of this invention can occur without a prepurge time period by removing the jumper 67 and utilizing the transistor Q3 and the resistances R13 and R8 so that once a signal is provided on the input pin 10 of the counter 66 by the thermostat 32 initially closing, the transistor Q5 is immediately turned on to energize the relay coil K1 of the relay 37 so as to immediately place the igniter 28 across the high voltage AC current 27 whereby the system 20 then functions in the same manner as the prepurge operation previously described.

Therefore, it can be seen that this invention not only provides a new hot surface ignition system for a gas furnace and the like, but also this invention provides a new method of making a hot surface ignition system for a gas furnace or the like.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a hot surface ignition system for a gas furnace and comprising a high voltage circuit for being connected to a source of high voltage AC current, said high voltage circuit having a hot surface igniter means therein and disposed in the path of gas issuing from a burner means that is adapted to be fed said gas from a source thereof through an electrically operated gas valve, a low voltage circuit for being connected to a source of low voltage AC current, said low voltage circuit having said gas valve therein and having thermostatic switch means therein controlling the energization of said low voltage circuit with said low voltage AC current, first relay means having contact means in said high voltage circuit and controlling the energization of said igniter means with said high voltage AC current, and other relay means having contact means in said low voltage circuit and controlling the energization of said gas valve, the improvement wherein said other relay means comprises two separate relays respectively having contact means that are disposed in series in said low voltage circuit whereby the contact means of said two relays must be in the same condition thereof to energize said gas valve.

2. A hot surface ignition system as set forth in claim 1 and further comprising a first timing means in said low voltage circuit for causing said first relay means to have said contact means thereof in a condition to energize said ignition means for a certain period of time after said first timing means has been activated.

3. A hot surface ignition system as set forth in claim 2 wherein said two relays activate said first timing means by connecting said low voltage AC current thereto when said contact means thereof are both in the same condition thereof and said thermostatic switch means is closed.

4. A hot surface ignition system as set forth in claim 3 wherein said two relays deactivate said first timing means by disconnecting said low voltage AC current therefrom when said contact means are in the condition thereof to energize said gas valve.

5. A hot surface ignition system as set forth in claim 4 and further comprising a second timing means in said low voltage circuit for causing said first relay means to continue to have said contact means in said condition to energize said igniter means for a second period of time after said first timing means has been deactivated.

6. A hot surface ignition system as set forth in claim 5 and further comprising a third timing means in said low voltage circuit for causing said two relays to have said contact means thereof maintained in the condition thereof to energize said gas valve for a certain period of time.

7. A hot surface ignition system as set forth in claim 6 and further comprising flame sensing means in said low voltage circuit for maintaining said contact means of said two relays in the condition thereof to energize said gas valve when said flame sensing means is sensing a flame at said burner means.

8. A hot surface ignition system as set forth in claim 7 wherein said flame sensing means comprises said igniter means.

9. A hot surface ignition system as set forth in claim 7 wherein said flame sensing means is remote from said igniter means.

10. A hot surface ignition system as set forth in claim 1 wherein said first relay means has a coil means for operating said contact means thereof, said coil means being in said low voltage circuit.

11. A hot surface ignition system as set forth in claim 1 wherein said two relays each has a coil means for operating said contact means thereof, each said coil means being in said low voltage circuit.

12. A hot surface ignition system as set forth in claim 11 wherein said coil means of said two relays are disposed in parallel in said low voltage circuit.

13. A hot surface ignition system as set forth in claim 11 wherein a field effect transistor means is in said low voltage circuit and controls the energization of said coil means of said two relays.

14. A hot surface ignition system as set forth in claim 13 and further comprising a flame sensing means in said low voltage circuit for maintaining said contact means of said two relays in the condition thereof to energize said gas valve when said flame sensing means is sensing a flame at said burner means, said flame sensing means when sensing said flame controls said field effect transistor and, thus, said two relays.

15. A hot surface ignition system as set forth in claim 14 wherein said igniter means comprises said flame sensing means.

16. A hot surface ignition system as set forth in claim 1 and further comprising a first timing means in said low voltage circuit for causing said first relay means to have said contact means thereof in a condition to energize said igniter means for a certain period of time after said first timing means has been activated, said first timing means having means to begin said certain period of time substantially immediately after said first timing means has been activated.

17. A hot surface ignition system as set forth in claim 1 and further comprising a first timing means in said low voltage circuit for causing said first relay means to have said contact means thereof in a condition to energize said igniter means for a certain period of time after said first timing means has been activated, said first timing means having means to begin said certain period of time after a prepurge delay period of time has elapsed from the time said first timing means has been activated.

* * * * *